United States Patent [19]

Needham et al.

[11] 4,050,843

[45] Sept. 27, 1977

[54] GAS TURBINE ENGINES

[75] Inventors: Peter Richard Needham, Bristol; Kenneth Richard Langley, Wotton-under-Edge, both of England

[73] Assignee: Rolls-Royce (1971) Limited, England

[21] Appl. No.: 634,849

[22] Filed: Nov. 24, 1975

[30] Foreign Application Priority Data

Dec. 7, 1974 United Kingdom ..... 52995/74

[51] Int. Cl.[2] ..... F01D 25/26

[52] U.S. Cl. ..... 415/116; 415/136

[58] Field of Search ..... 60/39.32; 415/12, 115, 415/116, 117, 134, 135, 136, 138

[56] References Cited

U.S. PATENT DOCUMENTS

| | | | |
|---|---|---|---|
| 3,146,992 | 9/1964 | Farrell | 415/12 |
| 3,520,635 | 7/1970 | Killman et al. | 415/136 |
| 3,807,891 | 4/1974 | McDow et al. | 415/134 |
| 3,860,358 | 1/1975 | Cavicche et al. | 415/134 |
| 3,966,354 | 6/1976 | Patterson | 415/116 |

*Primary Examiner*—Carlton R. Croyle
*Assistant Examiner*—L. F. Casaregola
*Attorney, Agent, or Firm*—Stevens, Davis, Miller & Mosher

[57] ABSTRACT

A seal clearance control device for maintaining a radial clearance between turbine blade tips and the surrounding seal ring. The shroud is controlled by a relatively fast response ring and a relatively slow ring the fast ring serving to control the radial growth of the sealing ring and the slow ring serving to control the radial contraction of the seal ring.

15 Claims, 4 Drawing Figures

GAS TURBINE ENGINES

This invention relates to gas turbine engines, and more particularly to an improved sealing device suitable for use as a rotor blade tip seal within the confines of a gas turbine engine.

One of the main problems encountered with most types of tip seals in the past is the fact that it has not been possible to maintain an adequate tip clearance under all engine conditions. With certain types of conventional tip seal it has been necessary to provide an excessive blade tip clearance when the engine is stationary or running at slow speeds to avoid rubbing of the seals at other conditions, this obviously is detrimental to engine performance.

It has been found that when an engine is quickly run up to operating speed the engine rotors undergo several stages of radial growth. In the first instance the relatively thin rotor blades expand quickly in response to increase in temperature and centrifugal loading and to this is added the radial growth of the rotor disc due to centrifugal loading. A further stage of thermal growth occurs when the relatively thick rotor disc heats up to operating temperature. During all the abovementioned phases of expansion the casing surrounding the rotor grows at a steadily decreasing rate during the overall heating up process. Therefore the tip clearance of the rotor blades must be calculated such as to tolerate all relative changes in growth of both the entire rotor and the casing.

The present invention concerns a turbine tip seal which is provided with means such that it is displaced in order to accommodate a substantial portion of the thermal growth of the turbine blades and the rotor.

The present invention provides a seal device comprising an annular sealing ring, a first annular control member having means engaging and supporting, and therefore cooperating with said annular sealing ring, said member having a relatively rapid thermal growth response rate such that it expands or contracts quickly in accordance with a temperature variation, and a second annular control member having means engaging, supporting and co-operating with the annular sealing ring, the second member having a relatively slow thermal response rate such that the member expands or contracts relatively slowly in accordance with a variation in temperature, the arrangement being such that upon an increase in temperature of the device the first annular control member expands relatively rapidly and by virtue of its engagement and co-operating means also expands the annular sealing ring, and upon a decrease in temperature of the device the second annular control member contracts relatively slowly and by virtue of its engagement and co-operating means thus contracts the annular sealing ring relatively slowly.

The annular sealing ring may comprise a plurality of segmental members adapted to be slidable circumferentially with respect to each other, or alternatively may be a continuous ring of resilient material.

The segmental members constituting the sealing ring may also be slidably mounted upon a circumferential array of radially extending dowels which are attached at their most radially outward extremity to fixed structure, or alternatively the sealing ring may be supported by a plurality of axially extending fingers connected to fixed structure.

In a further alternative embodiment of the invention the segmental members constituting the sealing ring may each be mounted upon a lever, each lever extending substantially parallel to the axis of the sealing ring and being pivotally attached to fixed structure.

Preferably in operation of the sealing device the segments are urged radially inwardly by fluid pressure.

Preferably the first annular control member has a relatively small mass and is adapted to be provided with a supply of high pressure fluid such that it expands or contracts quickly in accordance with the temperature of the fluid.

Preferably the second annular control member has a relatively large mass and is shielded from the supply of high pressure fluid such that it expands or contracts relatively slowly in accordance with the temperature of the fluid.

Preferably the first and second annular control members and the annular sealing ring are arranged coaxially with respect of each other.

In one embodiment of the invention the engagement means provided upon the first annular control member comprises a radially inwardly extending flange terminating in an axially extending annular spigot which co-operates with an axially extending portion provided upon the annular sealing ring.

Also the engagement means provided upon the second annular control member comprises a circumferentially extending axially projecting portion which co-operates with an axially extending projection provided upon the annular sealing ring.

The second annular control member may comprise a ring attached to the engine casing.

Alternatively the second annular control member comprises a portion of the engine casing.

The supply of high pressure fluid which is provided to the first annular control member comprises a supply of air from the high pressure compressor section of the engine which is directed to impinge upon or pass through the first annular control member.

Preferably the high pressure air after impinging upon or passing through the first annular control member is used for both cooling the annular sealing ring and for providing an air seal between a rotor and adjacent stators stages.

The invention also comprises a gas turbine engine having a sealing device as set forth above.

Several embodiments of the invention will be more particularly described by way of example only and with reference to the accompanying drawings in which.

Figure 1:
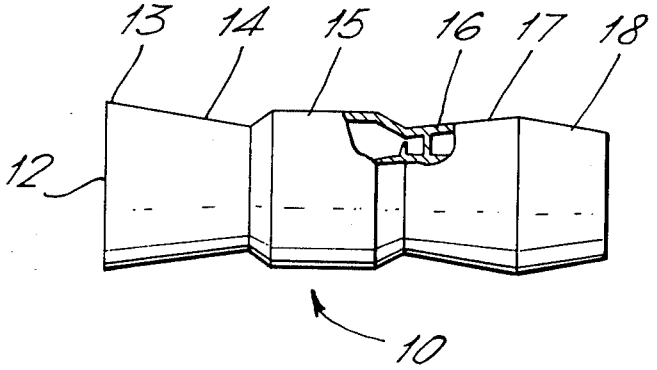
FIG. 1 shows a diagrammatic side elevation of a gas turbine jet propulsion engine having a broken away turbine portion showing a diagrammatic embodiment of the present invention.

Referring to FIG. 1 a gas turbine engine shown generally at 10 comprises an intake 12, low pressure compressor 13, high pressure compressor 14, combustion equipment 15, high pressure turbine 16, low pressure turbine 17 terminating in exhaust nozzle 18. The low pressure compressor 13 and low pressure turbine 17, and high pressure compressor 14 and high pressure turbine 16 being rotatably mounted upon respective common shafts not shown.

Figure 2:
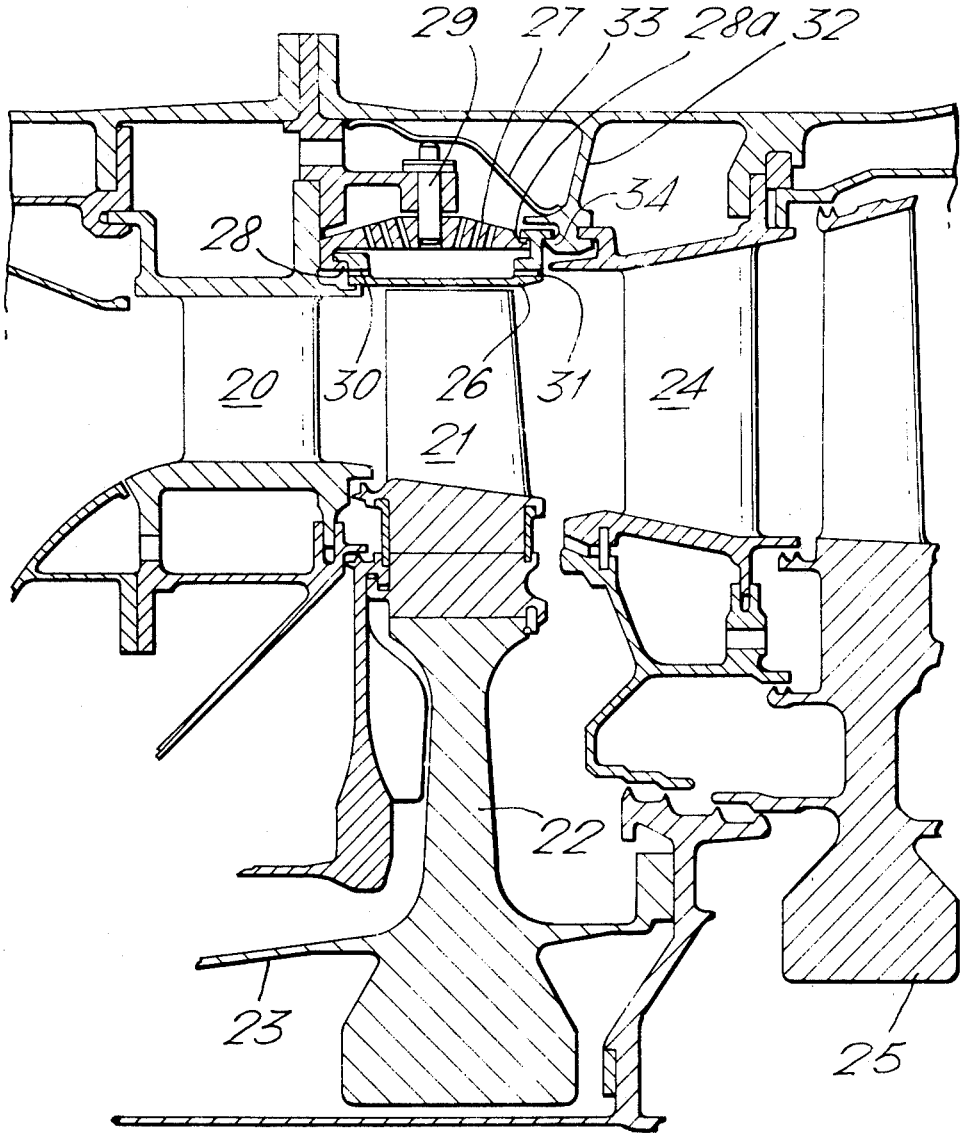
FIG. 2 shows an enlarged cross-sectional view of the turbine portion shown generally at FIG. 1 including one embodiment of the invention.

FIG. 2 shows an enlarged cross-sectional view in greater detail of the turbine portion shown schematically at FIG. 1 and comprises a radially extending array of nozzle guide vanes one of which is shown at 20 which are attached to engine fixed structure. A first turbine stage is arranged immediately downstream of the guide vanes 20 and comprises a radially extending array of turbine blades one of which is shown at 21. The blades 21 are secured by means not shown to a turbine disc 22 which is carried by the high pressure engine shaft, a portion of which is shown at 23.

A radially extending array of stator blades 24 is provided downstream of the turbine 21 which are secured at their radially outermost ends to engine fixed structure and at their radially innermost ends carry axially extending sealing structure which co-operates with sealing members provided upon the turbine disc 22 and adjacent downstream turbine disc 25.

Arranged radially outwards of the turbine blades 21 is a tip sealing member made in accordance with the present invention and comprises a sealing ring 26 which is made up from a plurality of segments a portion of one of which is shown in the drawing. An annular member 27 which constitutes a first annular control member is spaced radially outwards of the sealing ring and is provided at its upstream end with a radially inwardly extending flange which terminates in an axially extending annular spigot 28 which engages, co-operates with and serves to support the sealing ring 26. At its most downstream end the annular control member is provided with an axially extending annular spigot **28*a* which projects into an annular channel provided on the sealing ring 26, thereby serving to further support the sealing ring 26.**

The annular control member 27 is supported by a plurality of radially extending dowels one of which is shown at 29. The dowels 29 are secured at their radially outermost ends within holes provided within the engine casing. As will be seen from the drawing the annular control member 27 is also provided with a plurality of relatively small diameter holes these holes being provided to allow the throughflow of high pressure air from the high pressure compressor. The high pressure air serves two functions. First upon engine start-up the air passing through the control member 27 quickly brings it up to operating temperature. Therefore the ring expands quickly and by means of spigots 28 and **28*a* it also enlarges the diameter of the sealing ring 26, thus maintaining an adequate tip clearance between the blades and the sealing ring 26 and so accommodating thermal growth within the turbine. The high pressure air also serves a second function in that after passing through the annular control member 27 it impinges upon the segments forming the sealing ring 26 thus serving to provide a degree of cooling to it. The high pressure air is subsequently exhausted through two circumferentially extending arrays of apertures 30 and 31 to provide air seals between nozzle guide vanes 20 and stators 24, adjacent the turbine 21, and to provide film cooling for the segment forming the sealing ring 26** and the adjacent stator blade platforms.

Provided downstream and substantially radially outwardly of the first annular control member 27 is a substantially conically shaped casing portion 32 which constitutes a second annular control member. The second annular control member 32 is of a substantially larger mass than the first annular control member 27 and is shielded from the relatively high temperature high pressure air by means of an annular shield 33. It will be appreciated therefore that upon engine start-up while the first annular control member 27 is thermally responsive and will expand relatively quickly by virtue of its relatively small mass and direct contact with the high pressure air. The second annular control member will not be so thermally responsive due to its relatively larger mass and the shield 33 and therefore will expand more slowly until reaching approximately the same degree of expansion as the first annular sensing control. During normal engine cruise conditions both the control members 27 and 32 and the sealing ring 26 will assume substantially the positions shown in FIG. 2 of the drawing.

On shut down of the engine the first annular response member 27 will contract relatively quickly. However the sealing ring 26 will be retained in its expanded position by virtue of the axially extending spigot 34 provided upon the second annular control member 32. The second annular control member 32 will contract at a relatively slower rate than that of the first annular response member 27 and will thus control the degree of contraction of the sealing ring 26 thus preventing an interference between turbine blades 21 and sealing ring 26 upon engine shut down.

Figure 3:
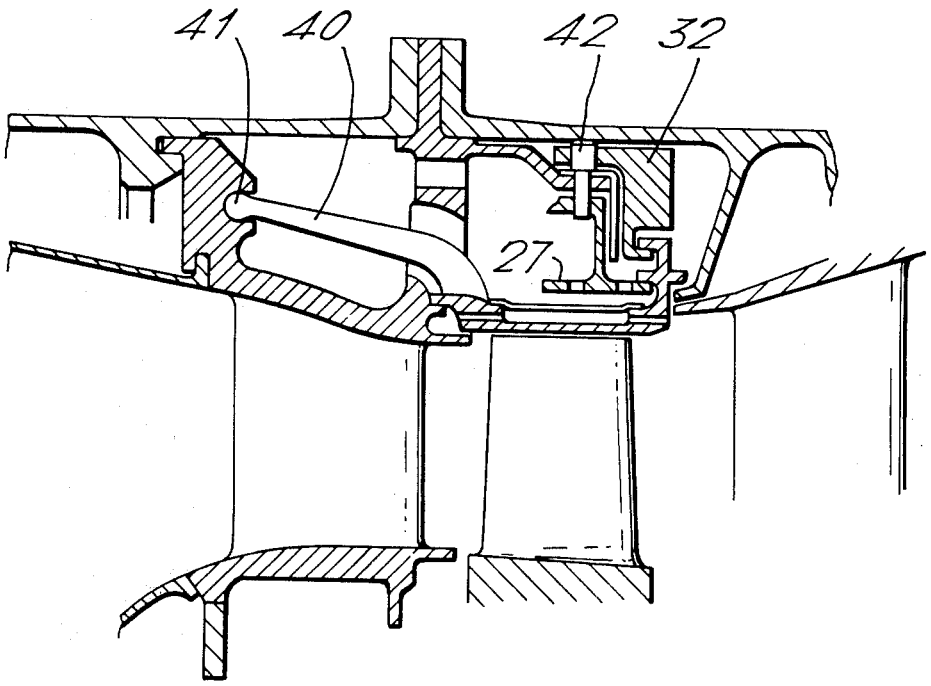
FIG. 3 shows a cross-sectional view of a second embodiment of the invention applied to a turbine.

FIG. 3 shows a second embodiment of the present invention. In this instance each of the plurality of segments making up the sealing ring 26 is supported from a plurality of relatively axially extending levers one of which is shown at 40. The plurality of levers 40 being pivotally mounted by means of spherical joints 41 from engine fixed structure.

In this example both the first annular control member 27 and the second annular control member 32 comprise rings both of which are slidably mounted from fixed structure by means of a common set of radially extending dowels which are secured at their radially outermost ends to the engine casing. However, it is envisaged that they could equally well be secured by means of suitably sized attenuation lengths. The functions of the elements described in this example follow those previously described with respect to FIG. 2. The use of a separate second annular control member 32 ensures that the mass or material specification of the member can be more readily tuned to the first annular control member 27. In some cases it is not either practical or desirable from a design viewpoint to make use of a portion of the engine casing for the second annular control member as it could result in either an excessively heavy or alternatively weak casing.

Figure 4:
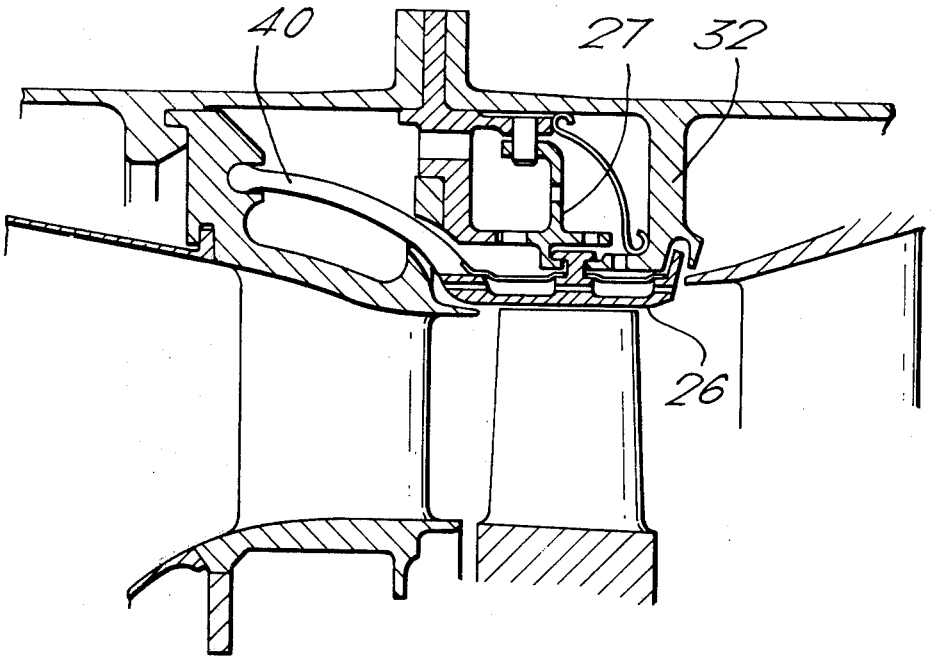
FIG. 4 shows a cross-sectional view of a third embodiment of the invention applied to a turbine.

FIG. 4 shows a further embodiment of the present invention. In this example the segments constituting the sealing ring 26 are mounted upon a plurality of levers 40 as in the FIG. 3 embodiment. However in this instance the second annular control member 32 forms a part of the engine casing structure. The first annular control member 27 takes the form of a separate member slidably mounted upon a plurality of radially extending dowels secured to the engine structure as in the FIG. 2 embodiment, and this example also functions in a substantially identical member to that of the FIG. 2 embodiment.

Although all the above described embodiments have shown a sealing ring 26 comprising a plurality of slidably arranged segments it is envisaged that these could be replaced by a continuous band of resilient material such as that sold under the Registered Trade Mark Felt Metal.

Although the invention has been described broadly it is envisaged that by suitable selection of metals forming the first and second control members and by careful sizing of the members the degree of expansion and contraction of the members can be controlled. In this way the sealing ring may be controlled by the individual control members such that the first annular control member pulls the sealing ring clear of the rotor blade tips for a predetermined length of time in accordance with a temperature increase, after which the sealing ring is controlled by the second control member. In this way the annular control members may be chosen to provide for a variety of engine operating characteristics.

We claim:

1. A gas turbine engine including a rotor having a relatively slow thermal growth response rate disposed adjacent non-rotating structure for operation over a range of speeds and temperatures, comprising:

an annular sealing ring surrounding a portion of the rotor to define a clearance therewith and being capable of radial expansion and contraction, means defining first and second radially inwardly facing surfaces on the ring, a first annular control member having a relatively high thermal growth response rate and having means for engaging and supporting at least a portion of the first surface of the ring, a second annular control member having a relatively low thermal growth response rate and having means for engaging and supporting at least a portion of said second surface of the ring, the surfaces of the ring and the engagement means on the control members being so juxtaposed that during any rapid increase in the operating temperature of the engine the ring is supported and expanded by the first control member and during any rapid decrease in the engine operating temperature, the ring is supported by the second control member and is constrained to contract at the same rate of contraction as said second control member.

2. A gas turbine engine as claimed in claim 1 in which the sealing ring has means defining two second radially inwardly facing surfaces, and two of said second annular control members are provided each having means for engaging at least a portion of a respective one of said second surfaces on the ring.

3. A gas turbine engine as claimed in claim 1 in which the sealing ring has means defining two first radially inwardly facing surfaces and the first annular control member is provided with means for engaging at least portions of each of said two first surfaces.

4. A gas turbine engine as claimed in claim 1 in which the engagement means on the first and second control members comprise means defining radially outwardly facing surfaces for engaging at least portions of the radially inwardly facing surfaces on the ring.

5. A gas turbine engine as claimed in claim 1 in which the sealing ring is formed in a plurality of circumferentially extending segments which are relatively circumferentially slidable to facilitate expansion and contraction thereof.

6. A gas turbine engine as claimed in claim 1 in which the sealing ring is continuous circumferentially and is resilient for expansion and contraction.

7. A gas turbine engine as claimed in claim 1 in which the rotor is a bladed rotor which comprises a rotor disc having a plurality of blades on the periphery thereof and the sealing ring surrounds the tips of the blades.

8. A gas turbine engine as claimed in claim 1 in which the first annular control member is provided with holes through which working fluid of the engine is directed to increase the thermal growth response rate of the member to changes in the engine operating temperature.

9. A gas turbine engine as claimed in claim 8 in which means are provided for shielding the second annular control member from the flow of working fluid directed through the first annular control member.

10. A gas turbine engine as claimed in claim 8 in which the flow of working fluid which passes through the holes in the first annular control member is further directed by the holes to impinge on the sealing ring for cooling thereof.

11. A gas turbine engine as claimed in claim 1 in which there are provided a plurality of levers, means for pivotally mounting one end of each of the levers onto the non-rotating structure and means for mounting the sealing ring onto the other ends of the levers.

12. A gas turbine engine as claimed in claim 1 in which the first annular control member is slidably mounted for radial expansion and contraction on a plurality of radially extending dowels spaced circumferentially around the ring, means being provided for securing the dowels to the non-rotating structure.

13. A gas turbine engine as claimed in claim 1 in which the second annular control member is part of a casing surrounding the rotor which in turn forms a part of the non-rotating structure.

14. A gas turbine engine as claimed in claim 1 in which the second annular control member comprises a ring of relatively large mass compared to the first annular control member which surrounds the sealing ring and is connected to the non-rotating structure for radial expansion and contraction relative thereto.

15. A gas turbine engine as claimed in claim 14 in which the second annular control member is slidably mounted from the non-rotating structure by dowels which also support the first annular control member.

* * * * *